US005289783A

United States Patent [19]

Karl

[11] Patent Number: 5,289,783

[45] Date of Patent: Mar. 1, 1994

[54] WEIGHTABLE TABLE UNIT

[76] Inventor: Richard B. Karl, 1825 Persimmon Dr., St. Charles, Ill. 60174

[21] Appl. No.: 951,778

[22] Filed: Sep. 28, 1992

[51] Int. Cl.[5] ..... A47B 13/02

[52] U.S. Cl. ..... 108/150

[58] Field of Search ..... 108/150, 154, 157, 160

[56] References Cited

U.S. PATENT DOCUMENTS

| | | | |
|---|---|---|---|
| 3,664,275 | 5/1972 | Kleinert | 108/150 |
| 3,726,201 | 4/1973 | Berchtold et al. | 108/150 X |
| 4,043,278 | 8/1977 | Kessler et al. | 108/150 |
| 4,401,036 | 8/1983 | Russo et al. | 108/150 X |
| 4,760,802 | 8/1988 | Leong | 108/150 X |
| 4,929,021 | 5/1990 | Kaye | 108/150 X |

*Primary Examiner*—Clifford D. Crowder
*Assistant Examiner*—John J. Calvert
*Attorney, Agent, or Firm*—John L. Schmitt

[57] ABSTRACT

A table unit particularly adapted for use in a correctional environment includes a base prepared to be filled with ballast. The base has a hollow core member that fits into an inner space of an outer shell member. A sidewall of the core member is spaced inward from a sidewall of the shell member to form a first ballast holding space therebetween. An inner space of the core member defines a second ballast holding space. For use the first holding space or both ballast holding spaces first are filled with ballast such as sand or gravel. Then, a table top is attached to an upper end of the outer shell member to form a completed work table unit. Ballast in the first holding space reinforces the sidewall of the outer shell member while weight of the ballast inhibits unauthorized movement or upsetting of the unit.

6 Claims, 2 Drawing Sheets

WEIGHTABLE TABLE UNIT

BACKGROUND OF THE INVENTION

1. Field of the Invention:

This invention relates to furniture for penal-type institutions and more particularly to a table unit having a base that may be selectively filled with ballast that reinforces a base of the unit against physical abuse and weights the unit to inhibit unauthorized movement of such.

2. Prior Art

A furniture piece commonly known as a table has been in use for many centuries. Tables are available in limitless sizes, configurations, and styles. The actual table form depends to a large degree upon its intended end use, and such uses are infinite. While most all tables include a table top which provides a flat, horizontal surface for support or other like use, means to carry the table top will vary. Many tables have a set of spaced apart legs to support the table top. Like table use means of table top support also are infinite.

For example, recently issued U.S. Pat. No. 4,760,802 discloses a table top supported by a centrally located column. this table includes a base having a top surface formed with a circular groove which includes a set of inwardly extending notches. A bottom end of the column fits into this base groove; a top end of the column then fits into a like groove in a bottom surface of the table top. The column is formed by joining two semicircular portions. Flanges on ends of each column portion abut and then fit respectively in the notches of the base and table top grooves.

U.S. Pat. No. Des. 300,468 sets out another table having a recessed work surface especially adapted for garden related work. The work surface of this table is supported by a pair of large, spaced apart legs. Each leg has a rectangular shape and seemingly is made of concrete studded with field stone.

Still further means of support is set forth in U.S. Pat. No. 4,929,021. While the ornamental support section shown is adapted for a stool, this section could be modified for table top support. The section includes a lower base element joined to an upper support casing by an elongated metal rod having ends threaded respectively to each. Positioned about the rod is a tubular member. In a further embodiment the tubular member is translucent for visual display of ball elements that then may be illuminated by a florescent tube that replaces the metal rod.

SUMMARY OF THE INVENTION

A weightable table unit particularly adapted for penal-type institutional use comprises a base having a hollow outer shell member. The shell member is defined by a circular sidewall and a connecting bottom wall. About an open upper end of this outer shell member is an peripheral flange that connects with and extends outward from an upper end of the sidewall.

The base further includes a hollow core member that fits in an inner space of the outer shell member. A circular sidewall of the core member has a lesser diameter than that of the outer shell sidewall so that a first ballast holding space is formed therebetween. An inner space of the core member defines a second ballast holding space.

For use the base core member first is fitted into the outer shell member. The resulting base first holding space and, if desired, second holding space then are filled with ballast. The ballast may be sand, gravel or concrete, for example. A top of the table unit then is placed on the base and attached to such by fasteners which extend though the outer shell flange and into a body of the top.

The resulting table unit of this invention provides several advantages not available from presently known or available correctional-type table units.

A first advantage is that the outer shell member and inner core member of the table unit base may be made of light weight, but quite strong material, for example fiberglass. Thus, the base components are readily portable until ready for assembly.

A second advantage is that once the base components are in their near final location, the base may be readily assembled and then weighted with ballast. Ballast filling the first holding space increases a weight of the base to about 250 pounds. If the second ballast holding space also is filled, the base weight increases to about 550 pounds. With the top then attached to the base, the resulting table unit is not readily movable at either weight level. Additionally, the ballast is so positioned in the base so that the table unit may not be easily upset.

A still further advantage is that ballast in the first holding space substantially strengthens the sidewall of the outer shell member. Furniture placed in a correctional environment often is subjected to physical abuse from those confined therein. The reinforced shell member sidewall of the table unit base is able to sustain considerable mistreatment.

DESCRIPTION OF THE DRAWING FIGURES

DESCRIPTION OF THE PREFERRED EMBODIMENT

Figure 1:
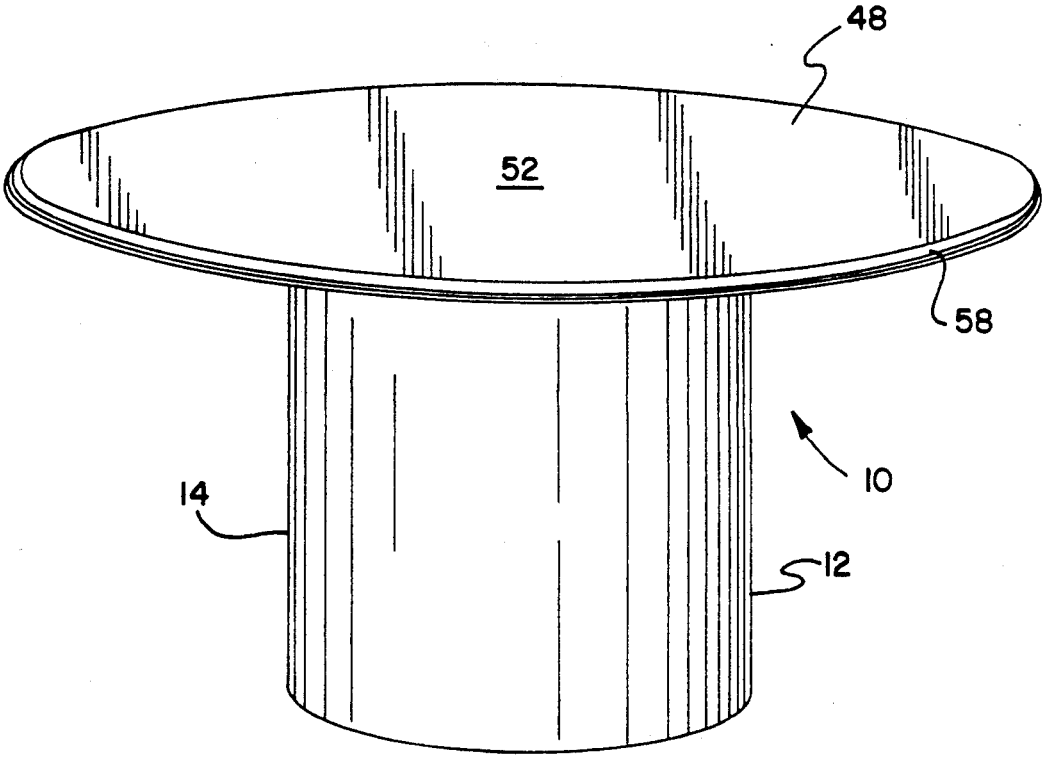
FIG. 1 is a perspective view of a table unit of this invention.
Figure 3:
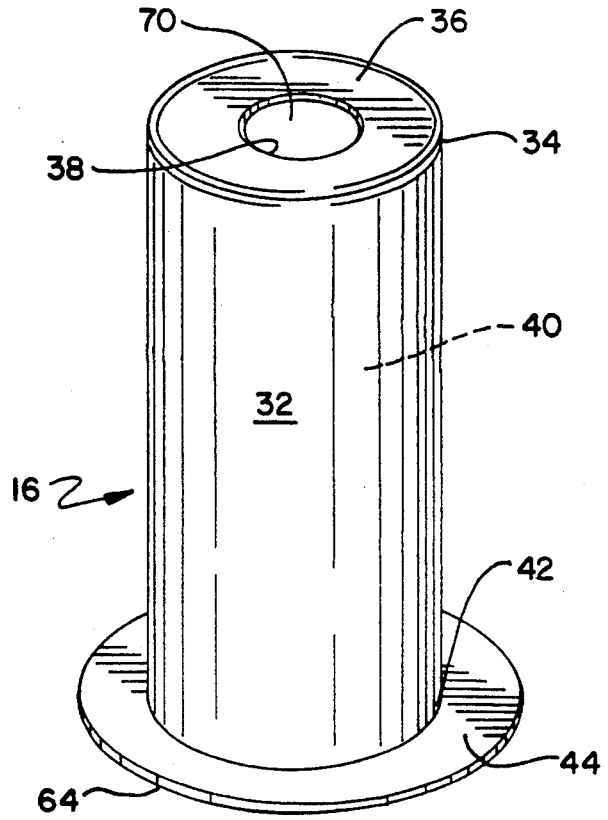
FIG. 3 is a perspective view of an inner core member of a base of the table unit.
Figure 4:
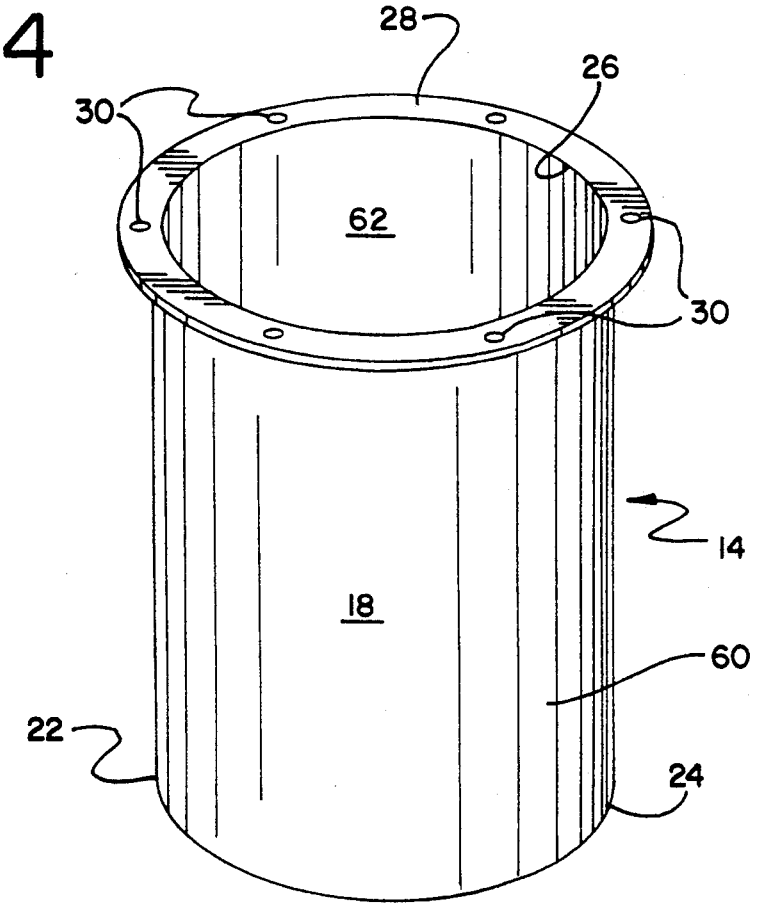
FIG. 4 is a perspective view of an outer shell member of the table unit base.

A table unit 10 of this invention is shown generally in FIG. 1 and designated 10. The unit 10 has a base 12 that is shown in greater detail in FIG. 2. The base 12 includes an outer shell member 14 and an inner core member 16 shown respectively in FIGS. 3 and 4.

The outer shell member 14 is hollow and has a circular sidewall 18. A bottom wall 20 of the outer shell member 14 joins a lower end 22 of the sidewall 18 to form a radiused corner 24. Connecting with an upper end 26 of the sidewall 18 is an outward extending top peripheral flange 28. In this top flange 28 is a series of spaced apart apertures 30.

The inner core member 16 also is hollow and has a circular sidewall 32. An upper end 34 of the sidewall 32 connects with a top wall 36. The top wall 36 has a large opening 38 to an inner space 40 of the core member 16. A lower end 42 of the inner core sidewall 32 connects with an outward extending bottom peripheral flange 44.

A top 48 of the table unit 10 is circular in shape. It should be understood that the top 48 and base 12 may be made in a number of different shapes, as required. The top 48 has a multiply particle board core 50. A top surface 52 of the top 48 is a high pressure laminate, which may include a decorative design. A bottom surface 54 of the top 48 is covered with a high pressure phenolic backing sheet. In the bottom surface 54 and embedded in the core 50 is a series of T-nuts 56. The nuts 56 are spaced to align with the flange apertures 30 of the outer shell member 14. An outer edge 58 of the top 48 is a radiused molding made of ceramic-like material that is integrally fused to the particle board core 50. This bonding procedure ensure that the edge molding 58 may not be easily detached.

The base outer shell 14 and inner core 16 preferably are molded from a fire retardant fiberglass material. An outer surface 60 of the shell member 14 has a high gloss finish. After manufacture the outer shell 14, inner core 16 and top 48 are shipped separately to a user location for assembly.

For assembly of the unit 10 the inner core member 16 first is placed flange down in an inner space 62 of the outer shell member 14. As the inner core bottom flange 44 comes to rest on the outer shell member bottom wall 20, an outer edge 64 of the inner core flange 44 seats against the outer shell member radiused corner 24 to form a positive, self-locating fit 66 therewith. This positioning creates a first ballast holding space 68 between the outer shell member sidewall 18 and inner core member sidewall 32. A second ballast holding space 70 then is defined by the inner space 40 of the inner core member 16.

Figure 2:
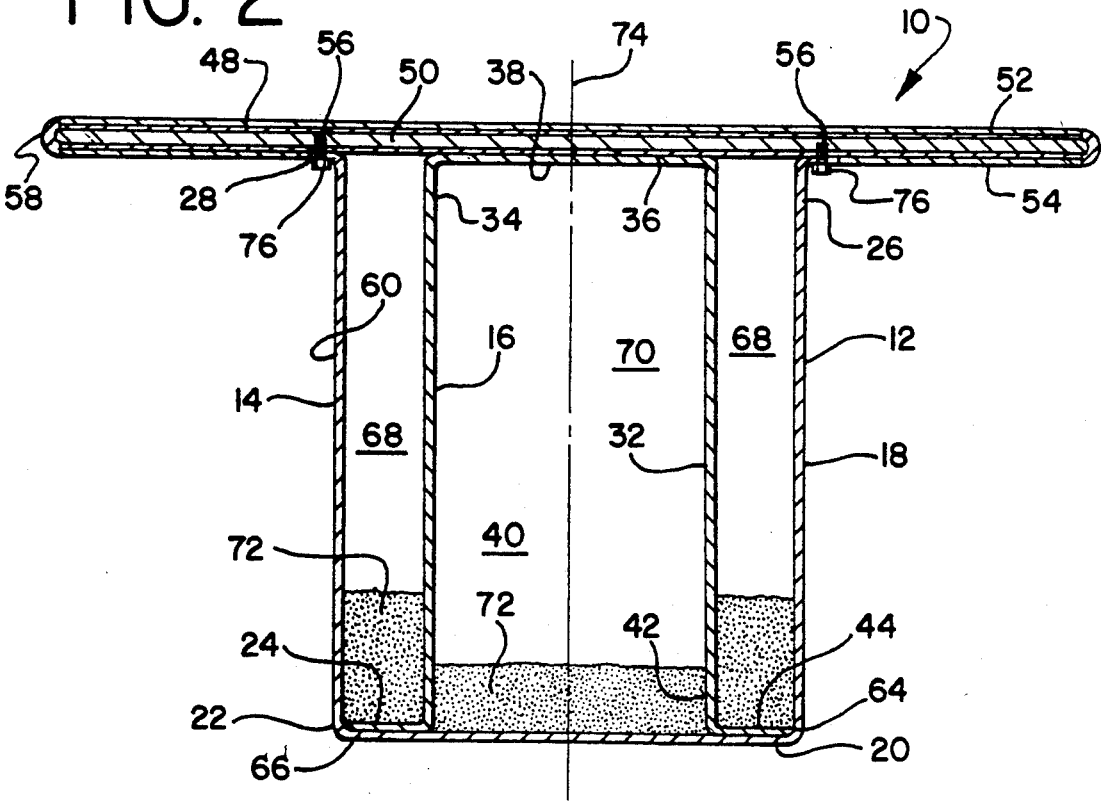
FIG. 2 is a cross sectional elevation view of the table unit of FIG. 1.

Next ballast 72, for example sand, gravel or concrete, is poured into the first ballast holding space 68. As ballast is added to this first holding space 68, the inner core member 16 remains firmly anchored in place. If required, the second ballast holding space 70 also may be filled with ballast 72 through the inner core top wall opening 38. FIG. 2 shows the holding spaces 68, 70 only partially filled with ballast 72. In practice at least the first holding space 68 should be full.

If sand forms the ballast 72, the base 12 weighs about 250 lbs. with the first holding space 68 full and then 550 lbs. with the second holding space 70 filled as well. Note that the integrity of the fit 66 is enhanced by weight of the ballast 72 in the first space 68 pressing the inner core bottom flange 44 tightly against the outer shell member bottom wall 20. This fit 66 inhibits ballast 72 in the first holding space 68 flowing into the second holding space 70, assuming this space 70 is empty. Thus, the weight of the base 12 remains evenly distributed about a vertical axis 74 of the base 12 to ensure base stability. Stability further is enhanced by the distance that ballast 72 in the first holding space 68 is located from the vertical axis 74.

With ballast 72 added to the base 12, the top 48 is placed bottom down on the top flange 28 of the outer shell member 14. The position of the inner core top wall 36 is such that this top wall 36 does not interfere with the bottom surface 54 of the top 48. Thus, the top 48 seats squarely on the outer shell member top flange 28. While not shown, the bottom surface 54 of the top 48 may be formed with a shallow, circular recess to hold the top flange 48. With the top T-nuts 56 then aligned with the shell top flange apertures 30, tamper-proof screws 76 are inserted through the apertures 30 and thread into the T-nuts 56 and secure the top 48 to the base 12.

Because of its increased weight and even weight distribution of the ballast 72, the resulting table unit 10 may not be readily moved or upset. Additionally, ballast 72 in the first holding space 68 reinforces the already strong outer shell member sidewall 18. The now fully assembled table 10 is highly resistant to physical abuse or use as an abusive instrument.

While embodiments, uses and advantages of this invention have been shown and discussed, it should be understood that this invention is limited only by the scope of the claims. Those skilled in the art will appreciate that various modifications or changes may be made without departing from the scope and spirit of the invention, and these modifications and changes may result in further uses and advantages.

What I claim is:

1. A weightable table unit comprising:

a base including a hollow outer shell member having a circular sidewall, said sidewall having a lower end connecting with a bottom wall and an upper end connecting with an outward extending peripheral top flange, and further including a hollow inner core member having a circular sidewall, said inner core member sidewall forming an outward extending bottom peripheral flange and an upper end connecting with an inward extending top wall formed with an enlarged opening to an inner space of said inner core member, said inner core member fitting into an inner space of said outer shell member with an outer edge of said inner core member bottom flange seating against said outer shell member bottom wall and sidewall to positively position said inner core member in said outer shell member inner space and form a first ballast holding space between said outer shell member sidewall and said inner core member sidewall, said first ballast holding space providing for uniform distribution of ready field-filling of ballast means about and spaced substantially away from a vertical axis of said table unit, ballast means carried in said base first ballast holding space to weight said table unit and add strength to said outer shell member sidewall with a weight of said ballast means providing considerable resistance to any unauthorized movement of said table unit and said spacing of said ballast means weight providing considerable resistance to upsetting of said table, and table top means particularly adapted to resist physical abusive treatment, said table top means attached to said outer shell member sidewall top flange, wherein said table unit may have an extended useful life in a correctional-type environment.

2. A table unit as defined by claim 1 and further characterized by, said ballast means being sand to weight said table unit to about 250 lbs. with said first ballast holding space being fully filled with said ballast means.

3. A table unit as defined by claim 4 and further characterized by, said inner space of said inner core member defining a second ballast holding space field-accessible through said inner core member top wall opening, said second ballast holding space being maintained apart from said first ballast holding space by said inner core member sidewall and bottom flange seating on said outer core member bottom wall, and a weight of said table unit being about 550 lbs. with said first and second ballast holding spaces being fully filled with said ballast.

4. A table unit as defined by claim 1 and further characterized by, said table top means positioned on said outer shell member flange being secured to such by tamper-resistant connections.

5. A table unit as defined by claim 1 and further characterized by, said table top means having a core of a particle board-like material, a top surface of laminate-like material bonded to said core, and an outer edge of ceramic-like molding bonded to said core.

6. A weightable base for a table unit particularly adapted for use in a penal-type environment, said base comprising:

a hollow outer shell member defined by a sidewall having a lower end joined to a bottom wall to form a radius corner at said joinder and an upper end connecting with an outward extending flange prepared for ready attachment to a table top, and an inner core member defined by a sidewall having a lower end joined to an outward extending bottom flange, said inner core member fitting in said outer shell member with said inner core member bottom flange sealing against said outer shell member bottom wall as an outer edge of said inner core member bottom flange forms a self-locating fit with said outer shell member radius corner to space apart said outer shell member sidewall and said inner core member sidewall and form therebetween a first ballast holding space for an even distribution of ballast about and substantially away from a vertical axis of said base, wherein during use said first ballast holding space is field-filled with said ballast to reinforce said outer shell member sidewall against physical abuse and a top is attached to said outer shell member upper end flange to form said table unit with said ballast providing substantial weight to said table unit that inhibits unauthorized movement of said unit and said even distribution and spacing of said ballast providing stability to said table unit that inhibits upsetting of said table unit.

* * * * *